US005203514A

United States Patent [19]

Mokvist et al.

[11] Patent Number: 5,203,514

[45] Date of Patent: Apr. 20, 1993

[54] REFINER WITH MEANS TO PROTECT THE REFINING DISCS FROM PREMATURE WEAR

[75] Inventors: Anders Mokvist, Snellville, Ga.; Thor Johansen, Minneapolis, Minn.

[73] Assignee: Sunds Defibrator Industries Aktiebolag, Sweden

[21] Appl. No.: 942,371

[22] Filed: Sep. 9, 1992

Related U.S. Application Data

[63] Continuation of Ser. No. 759,477, Sep. 13, 1991, abandoned.

[51] Int. Cl.[5] ..... B02C 7/12

[52] U.S. Cl. ..... 241/81; 241/261.3

[58] Field of Search ..... 241/261.2, 261.3, 81

[56] References Cited

U.S. PATENT DOCUMENTS

| | | | |
|---|---|---|---|
| 2,156,321 | 5/1939 | Sutherland, Jr. | 241/261.3 X |
| 4,253,613 | 3/1981 | Reinhall | 241/261.2 X |
| 4,269,365 | 5/1981 | Berggren | 241/261.2 X |
| 4,610,400 | 9/1986 | Sjouom | 241/261.2 |
| 4,820,381 | 4/1989 | Brown | 241/261.2 X |

FOREIGN PATENT DOCUMENTS

| | | | |
|---|---|---|---|
| 4059787 | 2/1967 | United Kingdom | 241/261.2 |

*Primary Examiner*—Mark Rosenbaum
*Assistant Examiner*—Frances Chin
*Attorney, Agent, or Firm*—Lerner, David, Littenberg, Krumholz & Mentlik

[57] ABSTRACT

The present invention relates to a device for protecting refining discs from excessive mechanical wear by preventing unwanted debris from coming between the discs.

21 Claims, 4 Drawing Sheets

REFINER WITH MEANS TO PROTECT THE REFINING DISCS FROM PREMATURE WEAR

This is a continuation of application Ser. No. 07/759,477 filed Sep. 13, 1991 now abandoned.

THE FIELD OF THE INVENTION

The present invention relates to the field of fiber making and specifically to protecting refining discs from excessive mechanical wear.

BACKGROUND OF THE INVENTION

During the production of fibers for paper making, wood or another fiber source is ground into chips and chemically and/or mechanically treated such that the chips may be broken down further and refined into individual fibers.

The actual production of fibers generally takes place inside a refiner. In the refiner, chips and other pre-fiber material are brought into contact with one or more rotating discs, such as those described in U.S. Pat. No. 2,156,321. The interaction of the wood or other cellulosic material with the refining rings of the refining discs causes the individual fibers contained within the cellulosic material to separate from one another.

Refiners may include a single rotating disc in close opposition to a stationary disc, or may involve two counter rotating discs. In either circumstance, however, it is important that the material introduced between the various refining discs be uniform in size, water content, and most importantly composition. For example, the introduction of rocks or metal into the gap between refining rings of the refining discs, along with cellulosic material to be processed, could dramatically reduce the useful life of the refining segments which make up the refining ring. This is particularly true when the cellulosic material used for the production of fiber contains a great deal of contaminants such as rocks, metal fragments, or other debris which have not, or cannot, be pre-separated.

Depending upon the size and throughput of the refiner, unwanted contaminants can ruin a refining disc in a matter of seconds, or at very least, reduce the normal life thereof. The costs of replacing the refining disc can run into thousands of dollars in parts alone. The time taken in replacing the disc and the lost production time caused thereby can dramatically increase the overall costs.

The present invention relates to a device which is designed to be associated with a refiner, either originally or as a retrofit, to protect the refining discs from contaminants.

OBJECTS AND SUMMARY OF THE INVENTION

It is the object of the present invention to provide a device which may be used in conjunction with a conventional fiber refiner to protect the refining discs from damage caused by contaminants.

In accordance with one aspect of the present invention, there is provided a fiber refiner including a first and a second opposed refining disc, the first and second opposed refining discs being separated from one another and, at the periphery thereof, defining a refining zone. The refining zone has an entranceway through which material must pass before entering and while entering the refining zone and an exit, generally at the outermost periphery of the refining discs. At least one of the first and second refining discs has an inlet and at least one of the first and second refining discs is rotatable about its axis to thereby cause material to move outwardly from the inlet to and through the entranceway of the refining zone. Interposed between the inlet and the entranceway of the refining zone there is also provided guard means for urging material in a direction away from the entranceway of the refining zone.

The refiner may also include a means for receiving material deflected in a direction away from the entranceway by the guard means.

In a particular preferred embodiment, the guard means for urging material in a direction away from the entranceway of the refining zone includes at least a first deflecting ring attached to the first refining disc and at least one second deflecting ring attached to the second refining disc. The first and second deflecting rings being at least partially in opposition and are separated by a gap.

In conventional refiners, cellulosic feed material is introduced into a refiner near the axis of rotation of one or more rotating refining discs. Then, either through centrifugal force alone, or with the assistance of some additional structure, the material disperses outwardly towards the periphery of the refining discs. At the disc's periphery are the refining disc segments which make up a pair of opposed refining rings and which define a refining zone having an entranceway and an exit. Thus, the material moves outwardly from the inlet to and through the entranceway of the refining zone to be refined into fibers. In the refining zone, individual fibers are torn apart from chips and fiber bundles. Thereafter, the fibers are collected and, optionally, subsequently dewatered and further treated.

When contaminants enter a conventional refiner along with a slurry of cellulosic feed material, they too are fed into the gap between the refining discs and into the refining zone. However, because of their size and composition, these contaminants can gouge and/or destroy the refiner disc immediately reducing their effectiveness in providing homogeneous fibers and, eventually, destroying the usefulness of the disc entirely.

The present invention can aid in alleviating this problem thus extending the life of the refiner discs and lowering the down time of a refiner. This is accomplished by adding certain structures to the refiner which limits access to the refiner discs to only material intended to be refined or to contaminants which are too small to have a significant impact on the life of the refiner disc. This is accomplished by deflecting or urging contaminant material in a direction away from the entranceway to the refining zone and, in a preferred embodiment, into a convenient collecting or receiving area.

Furthermore, and in a preferred embodiment, the device of the present invention provides a gap in the guard means which may be oriented axially when compared to the normal "radial" flow of material between the inlet and the refining zone. By so orienting the gap, the pathway to the refining zone becomes complicated and contaminants may be excluded thereby. The gap is too small for dangerous contaminants to get through. Both the size and the relative orientation of the gap aid in preventing contaminants from reaching and traversing the entranceway of the refining zone.

Finally, the apparatus of the present invention is equipped with structure which will grind or destroy contaminants such that the contaminants will not pose as much of a danger to the refining discs as might otherwise occur, even if allowed to pass therethrough. The later structure also can assist in the prerefining of fiber material.

DETAILED DESCRIPTION OF THE PREFERRED EMBODIMENTS

Figure 1:
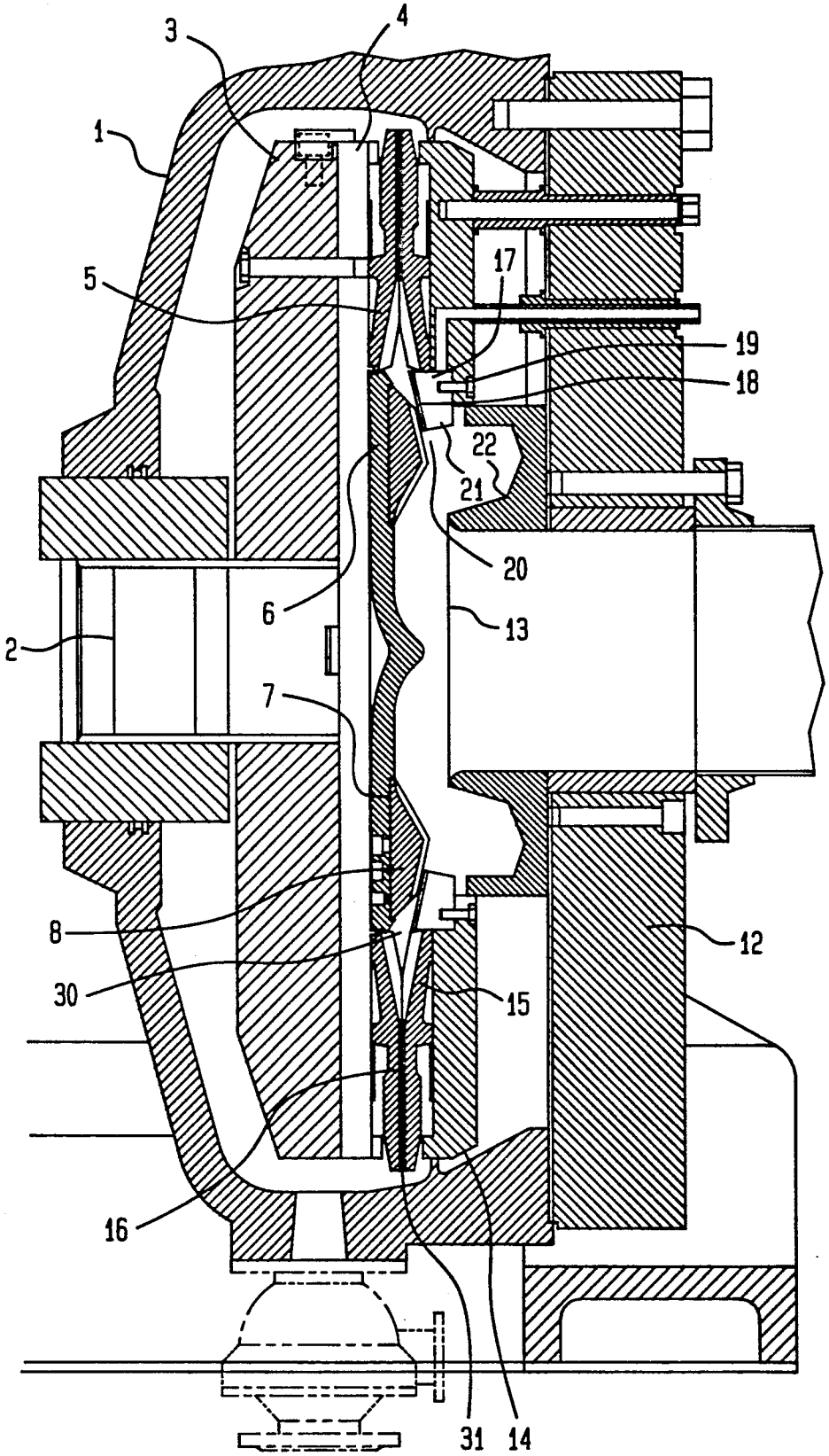
FIG. 1 is a cross-sectional view of a refiner in accordance with the present invention.
Figure 2A:
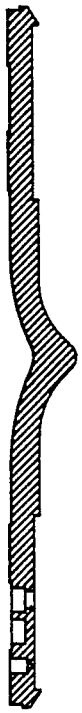
FIG. 2A is a cross-sectional side view of the first backing disc in accordance with the present invention.
Figure 2B:
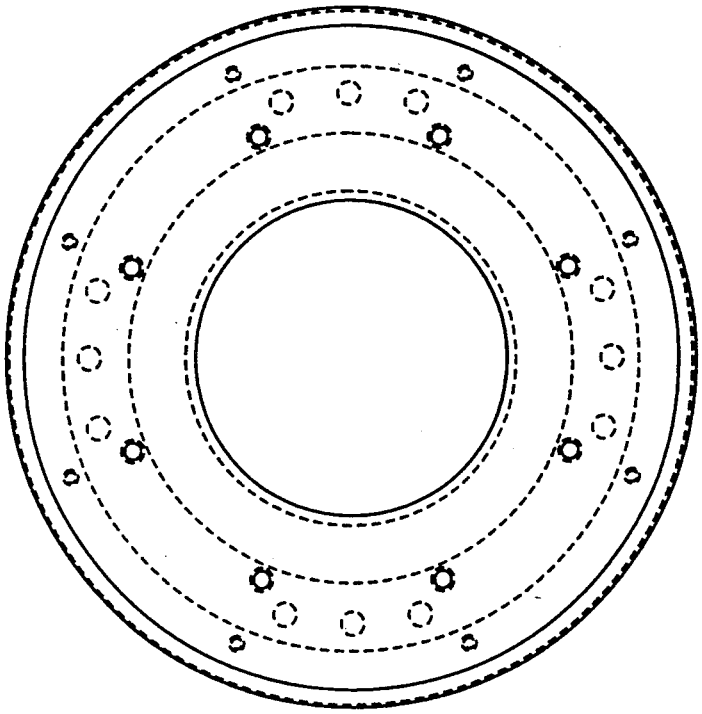
FIG. 2B is a planar view of the first disc of FIG. 2A.
Figure 3A:
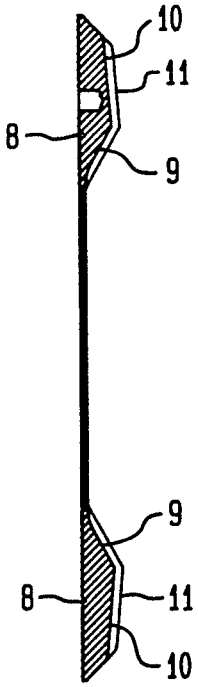
FIG. 3A is a cross-sectional view of the first deflecting ring.
Figure 3B:
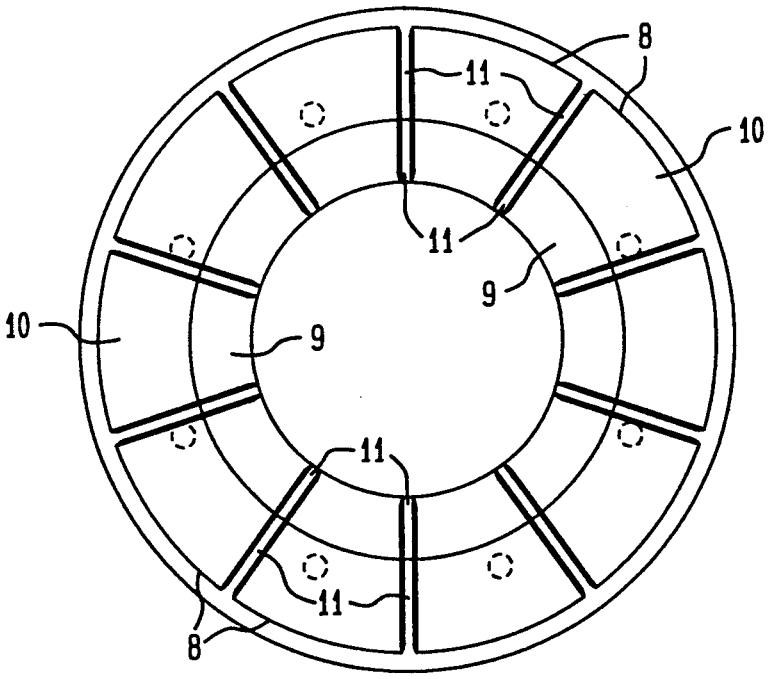
FIG. 3B is a planar view of the first deflecting ring of FIG. 3A.
Figure 4A:
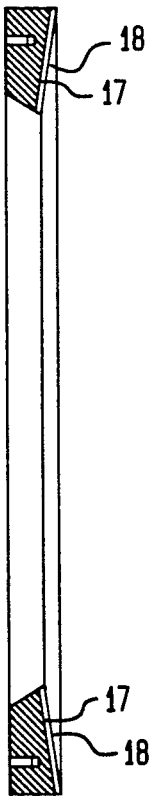
FIG. 4A is a cross-sectional side view of a second deflecting ring.
Figure 4B:
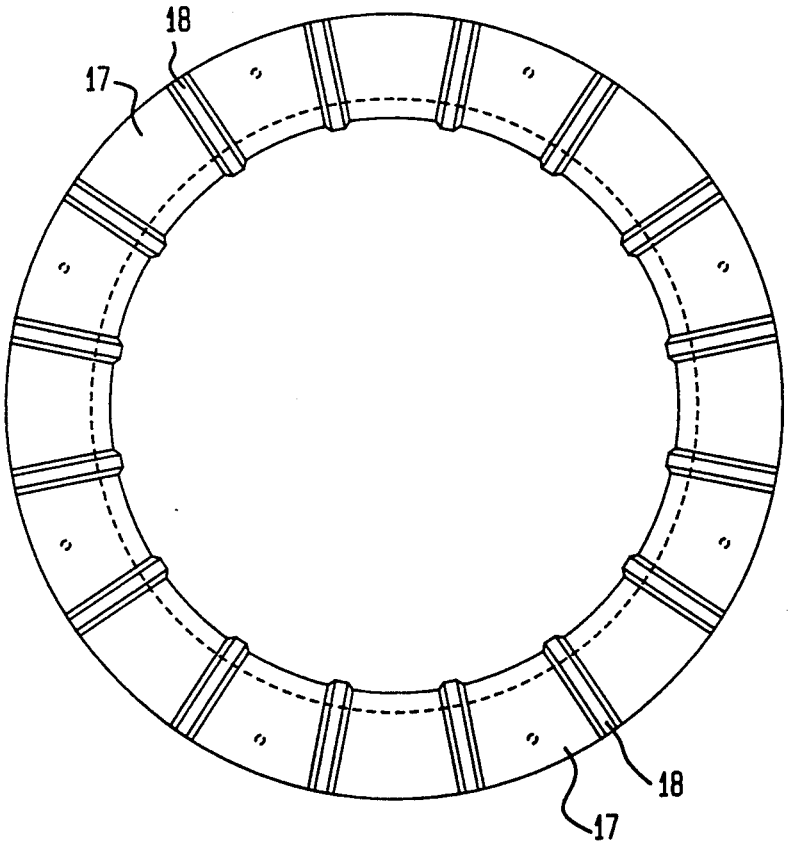
FIG. 4B is a planar view of the second deflecting ring of FIG. 4A.

The present invention involves the use of a device in conjunction with a refiner for purposes of aiding to deflect, exclude, and/or destroy unwanted contaminants carried into the refiner along with the cellulosic material to be refined. The apparatus of the present invention may be retrofitted into already existing refiners to provide additional contaminant removal or may be originally constructed into a specific refiner. For simplicity, the present invention will be described hereinafter in terms of a single rotating disc refiner wherein one disc rotates and another disc in opposition thereto remains fixed and stationary. However, the invention is not limited thereto.

The refiner of the present invention includes a housing 1, a shaft 2 which is connected at one end to a motor (not shown) and, at another end to one or more staging discs 3 and/or 4. These staging discs will hold the various refining segments of the first refining ring 5 and will translate the rotational energy of the shaft into rotational movement of the first refining ring 5. The first refining ring 5 is a ring made up of refining segments as is known, and is arranged and affixed toward the periphery of the staging discs 3 and/or 4. The first refining ring 5 and the various staging discs 3 and/or 4 make up the first refining disc.

Within the area defined by the inner most edge of the first refining ring 5 is attached a first backing disc 6. The first backing disc 6 may be attached to staging discs 3 and/or 4 by the use of screws, bolts or other conventional fastening devices. In a particular preferred embodiment the first backing disc 6 includes a recess 7 which is specifically adapted to receive, retain, and position a first deflecting ring 8. The recess 7 is preferably placed at the periphery of the first backing disc 6 such that the first deflecting ring 8 can be so placed. Of course, it is possible that the first deflecting ring 8 and the first backing disc 6 may be manufactured as a single piece.

The first deflecting ring 8 includes an inner-angled surface 9 which slopes away, relative to the plane of the first backing disc 6 and/or the imaginary center of the first deflecting ring 8. The first deflecting ring 8 further includes a first major surface 10 which may be parallel to the plane of the first backing disc 6 or may be angled such that the junction of the inner-angled surface 9 and the first major surface 10 forms the highest point of either surface. The slope of the inner-angled surface 9 may range from between about 30 degrees to about 60 degrees, but is preferably about 45 degrees.

In a particular preferred embodiment of the present invention, the first deflecting ring 8 further comprises a plurality of course grinding bars 11 which radiate from the inner edge of the first deflecting ring 8 to the outer edge thereof. Preferably, the course grinding bars 11 radiate from the lowest point of the inner-angled surface 4 to the furthest outer edge of the first major surface 10. The course grinding bars 11 may be of any size or shape. However, the present inventors have found that grinding bars having a trapezoidal cross-section and having a height above the inner-angled surface 9 and the first major surface 10 of between about 3 and about 6 millimeters are preferred. Particularly preferred is a height of approximately 6 millimeters.

It is of course possible for the height of the course grinding bars to be greater or less than between about 3 millimeters and about 6 millimeters depending upon the type of material to be refined, the throughput and size of the refiner and the material's consistency. However, it has been found that grinding bars greatly in excess of 6 millimeters tend to chip and break, and grinding bars of less than 3 millimeters are generally inefficient and ineffective. The size of the base of the trapezoidal cross-section grinding bar can vary widely. However, it is preferred that the width be between about 20 and about 30 millimeters and more preferably about 26 millimeters. Similarly, the width of the top of the trapezoidal cross-section of the grinding bar can vary widely in size but is preferably between about 5 and about 15 millimeters in width and most preferably about 12 millimeters in width when incorporated in the grinding bars as described herein. The number of grinding bars may also vary as necessary. The number of grinding bars may range from about 5 to about 30 but preferably varies from between about 10 to about 20.

The housing 1 also contains a plate 12 which has an orifice or inlet 13 through which material may be fed into the refiner. Attached to plate 12 is a staging disc 14 to which is further attached a second refining ring 15 which is similar in construction to the first refining ring 5 but in opposition thereto. The are between the refining ring 5 and the refining ring 15 is the refining zone 16, which has an entranceway 30 on the inlet side of the zone and an exit 31 at the refining discs outermost periphery. The dimensions of area 16 may taper and change with the dimensions of the first and second refining rings 5 and 15. The second refining ring 15 and staging disc 14 are collectively known herein as the second refining disc.

Located within the area defined by the inner most edge of the second refining ring 15 is a second deflecting disc 17 having a second major surface 18 which is opposed to the first major surface 10 of the first deflecting ring 8. The second deflecting ring 17 is attached to the staging disc 14 in any conventional manner. In refiners where the second refining disc is fixed, the second deflecting ring 17 may be attached to the staging disc 14 through a shim 19 or other means for adjusting the relative position of the second deflecting ring 17. By adjusting the position of the second deflecting ring 17 relative to the first deflecting ring 8, the gap 20 defined as the distance between the second major surface 18 of the second deflecting ring 17 and the first major surface 10 of the first deflecting ring 8 may be adjusted. The second major surface 18 of the second deflecting ring 17 may further include course grinding bars 21 which may be of identical size, composition, number and arrangement as the course grinding bars 11. They are not, however, necessarily identical thereto.

Gap 20 generally ranges from between about 12 and about 23 millimeters. However, it is more preferable that the distance between the first major surface 10 and the second major surface 18 be between about 18 millimeters and about 22 millimeters with about 22 millimeters being most preferred. Of course the distance of separation may be adjusted by the use of, for example, shims 19 such that the size of gap 20 may be increased or decreased. This is advantageously done to accommodate varying apparatus and conditions.

It is preferred that the gap 20 be oriented such that the direction of material flowing therethrough has a relatively axial component. This is accomplished by angling the first major surface 10 and the second major surface 18 such that they are parallel with respect to each other but in a plane which bisects the plane of the first and second refining rings. This is best illustrated in, for example, FIG. 1. By so orienting gap 20, material is forced to make a very sharp turn around the junction of the inner angled surface 9 and the first major surface 10 in order to gain access to and through gap 20. Such an orientation of gap 20 should not prevent cellulosic material from reaching the entranceway of refining zone 16 but should provide additional deterrent as far as contaminants are concerned. Refining gap 20 may also be oriented generally radially such that material flowing through the gap travels in a path very much like the otherwise uninterrupted pathway of cellulosic material travelling from inlet 13 to the refining zone 16.

Figure 5:
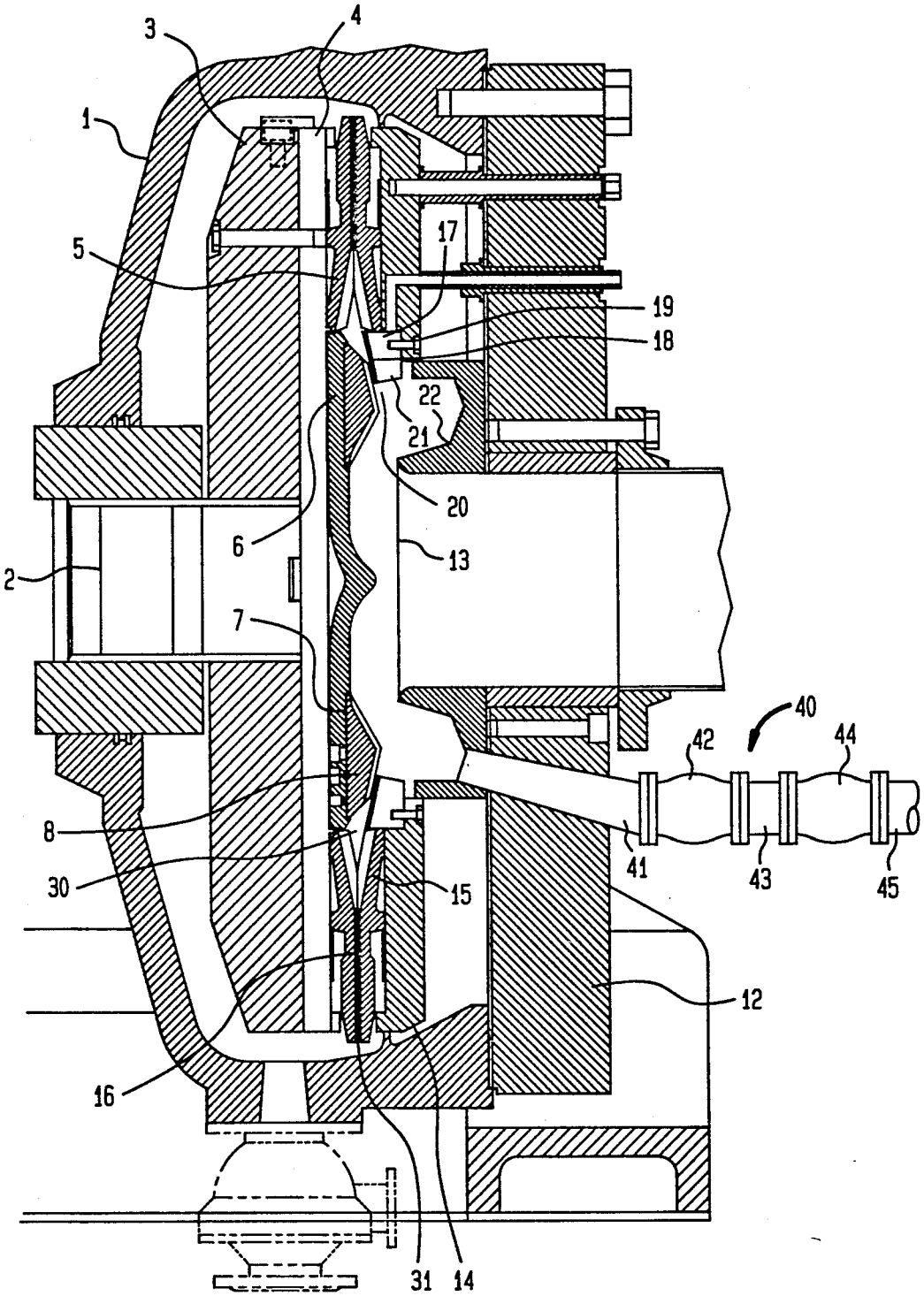
FIG. 5 is a cross-sectional view of a refiner in accordance with the present invention illustrating a means for removing material.

Between the inlet 13 and the inner most edge of the second deflecting disc 17 is a recess 22 or other means for receiving material and into which rocks, metals and other contaminants may be deflected or urged by the guard means. As will be readily apparent, the guard means for urging material in a direction away from the entranceway of the refining zone, in one preferred embodiment, includes both the first deflecting ring 8 and the second deflecting ring 17 and the structure associated therewith. This recess 22 may be lined with magnetic material to aid in retaining metallic material. Optionally, the recess 22 may further comprise a means for removing the unwanted contaminants from both recess 22 and from the apparatus of the present invention in general. As illustrated in FIG. 5, this device 40 could be constructed from a conduit 41 which leads to a first valve 42. Valve 42 is also connected to chamber 43 into a second valve 44. Finally, valve 44 is also connected to a pipe 45. By opening valve 42, material will be allowed to flow from the recess 22 through conduit 41 into chamber 43. Valve 42 may then be closed to preserve the integrity, temperature and pressure within the refiner. Thereafter, valve 44 may be opened and the material removed from the recess 22 may exit from the chamber 43 through pipe 45. Thereafter, the valve 44 may be reclosed and the procedure started again as necessary.

In operation, cellulosic material is introduced into the refiner through inlet 13. The material is introduced in a generally axial direction, i.e., in the direction of the common axis of the first and the second refining disc. From there, the material must travel in a generally radial direction outwardly toward the entranceway 30 to the refining zone 16 and therethrough. Cellulosic material must, therefore, "turn a corner" from its generally axial introduction to a generally outward or transverse direction.

When the cellulosic material is inside the refiner, and as it makes its way outward, the cellulosic material is deflected by the first deflecting ring 8, and the material is urged in a direction away from the entranceway 30 to refining zone 16. In a particularly preferred embodiment, the material is deflected toward the means for receiving material which, in one embodiment, is an annular recess 22.

Because the guard means includes not only the first deflecting ring 8 and the second deflecting ring 17 but also gap 20, which is defined by the distance between the first deflecting ring 8 and the second deflecting ring 17, and because of the relative orientation of gap 20, material must also negotiate or "turn a corner" and enter gap 20 before being fed to the entranceway 30 of the refining zone 16. Once the cellulosic material reaches the entranceway 30 at refining zone 16, it is acted upon by first refining ring 5 and the second refining ring 15 as the former rotates relative to the position of the latter. Within the refining zone 16 and in the distance between the first refining ring 5 and the second refining ring 15, the cellulosic material is forced to separate into individual fibers. As the centrifugal force generated by the rotation of first the refining disc and the forces generated by the continual influx of cellulosic material through inlet 13 act upon the fibers in the refining zone 16, they are forced to the outermost periphery of the first and the second refining discs and, therefore, exit the refining zone through exit 31.

Metal, rocks, and other contaminants generally are relatively heavy by comparison to the cellulosic material entering the refiner through inlet 13. Because of their relative weight, these contaminants may be unable to change direction as quickly as the cellulosic material introduced into the refiner. They are, therefore, more likely to strike and be deflected by the first deflecting ring 8 up into recess 22 and thereby, in a direction away from the entranceway 30 of the refining zone 16. These contaminants may, at least for a time, remain in recess 22. However, they may also be swept up and fed back into the main flow of cellulosic material only to be redeflected by the first deflecting ring 8.

If a contaminant is able to escape the cycle of collection and redeflection just described, it still must make the sharp change in direction necessary to enter gap 20 and must be small enough to pass therethrough. Unable to "make the turn" or too large to enter the gap, the contaminants should eventually be swept back up into the cycle of collection and redeflection.

Of course, it is possible that stones, metal, or other contaminants may eventually be able to enter gap 20. However, upon doing so, the grinding bars 11 and 21 should serve to contact the contaminant crush or deform if such that the contaminant is less likely to have a significant impact on the useful life of the first refining ring 5 and the second refining ring 15.

The principles, preferred embodiments and modes of operation of the present invention have been described in the foregoing specification. The invention which is intended to be protected herein, however, is not to be construed as limited to the particular embodiments disclosed, since these are to be regarded as illustrative rather than restrictive. Variations and changes may be made by others without departing from the spirit and scope of the invention.

We claim:

1. A fiber refiner comprising a first and a second opposed refining disc, said first and said second opposed refining discs being separated from one another and, at the periphery thereof, defining a refining zone having an entranceway and an exit, at least one of said first and second refining discs having an inlet and at least one of said first and second refining discs being rotatable about its axis to thereby cause material to move outwardly from said inlet to said entranceway of said refining zone and, interposed between said inlet and said entranceway, and into a means for receiving material deflected in a direction away from said entranceway by said guard means such that said deflected material is removed from the flow of the remaining material outwardly from said inlet to said entranceway of said refining zone so as to prevent said deflected material from entering said refining zone.

2. The refiner of claim 1 wherein said receiving means includes means for retaining material urged therein.

3. The refiner of claim 1 wherein said receiving means further comprises a means for removing material therefrom.

4. The refiner of claim 1 wherein said receiving means is an annular recess.

5. The refiner of claim 1 wherein said guard means for urging material in a direction away from said entranceway comprises at least a first deflecting ring attached to said refining disc and at least one second deflecting ring attached to said second refining disc, said first and said second deflecting rings being at least partially in opposition and being separated by a gap.

6. The refiner of claim 5 wherein said gap is oriented such that the direction of material flowing therethrough has a relatively axial component.

7. The refiner of claim 5 wherein said second deflecting ring includes a second major surface which is generally parallel to said first major surface on said first deflecting ring.

8. The refiner of claim 5 wherein said gap ranges from between about 12 millimeters to about 23 millimeters.

9. The refiner of claim 8 wherein said gap ranges from between about 18 millimeters to about 22 millimeters.

10. The refiner of claim 9 wherein said gap is about 22 millimeters.

11. The refiner of claim 5 wherein said second deflecting ring includes a plurality of coarse grinding bars.

12. The refiner of claim 11 wherein said coarse grinding bars have a height ranging from between about 3 to about 6 millimeters.

13. The refiner of claim 12 wherein said coarse grinding bars have a height of about 6 millimeters.

14. The refiner of claim 5 wherein said at least one first deflecting ring is attached to said first refining disc by a first backing disc interposed therebetween, said first backing disc including a recess specifically adapted to and position said first deflecting ring.

15. The refiner of claim 5 wherein said first deflecting ring has at least one surface which is angled outwardly with respect to the center of said ring.

16. The refiner of claim 15 wherein said angled surface ranges in angle from between about 30° to about 60°.

17. The refiner of claim 16 wherein said angled surface has an angle of about 45°.

18. The refiner of claim 15 wherein said first deflecting ring includes a first major surface which is connected to said angled surface.

19. The refiner of claim 5 wherein said first deflecting ring further comprises a plurality of coarse grinding bars.

20. The refiner of claim 19 wherein said coarse grinding bars range in height from between about 3 to about 6 millimeters.

21. The refiner of claim 20 wherein said coarse grinding bars are about 6 millimeters high.

* * * * *

UNITED STATES PATENT AND TRADEMARK OFFICE

CERTIFICATE OF CORRECTION

PATENT NO. : 5,203,514

DATED : April 20, 1993

INVENTOR(S) : Anders Mokvist, et al.

It is certified that error appears in the above-identified patent and that said Letters Patent is hereby corrected as shown below:

On the title page, Item: (75), "Minneapolis" should read --Prior Lake--.

Column 4, line 51, "discs" should read --disc's--.

Signed and Sealed this

Twenty-second Day of February, 1994

*Attest:*

Bruce Lehman

BRUCE LEHMAN

*Attesting Officer*

*Commissioner of Patents and Trademarks*